United States Patent [19]

Morino et al.

[11] 4,381,757

[45] May 3, 1983

[54] CONTINUOUS TYPE IGNITION DEVICE FOR AN INTERNAL COMBUSTION ENGINE

[75] Inventors: Seiji Morino, Aichi; Hisasi Kawai, Toyohashi; Norihito Tokura, Okazaki, all of Japan

[73] Assignee: Nippon Soken, Inc., Nishio, Japan

[21] Appl. No.: 171,760

[22] Filed: Jul. 24, 1980

[30] Foreign Application Priority Data

Jul. 30, 1979 [JP] Japan ..... 54-96985

[51] Int. Cl.[3] ..... F02P 5/04

[52] U.S. Cl. ..... 123/606; 123/622; 123/637; 123/655; 315/209 T

[58] Field of Search ..... 123/606, 607, 637, 655, 123/621, 622; 315/209 T

[56] References Cited

U.S. PATENT DOCUMENTS 3,280,809 10/1966 Issler .
3,841,287 10/1974 Nielsen ..... 315/209 T
4,051,828 10/1977 Topic ..... 315/209 T
4,245,594 1/1981 Morino et al. ..... 123/606
4,261,318 4/1981 Igashira et al. ..... 123/606

FOREIGN PATENT DOCUMENTS 1350334 12/1963 France ..... 123/637

*Primary Examiner*—P. S. Lall
*Attorney, Agent, or Firm*—Cushman, Darby & Cushman

[57] ABSTRACT

A pair of power transistors in a push-pull connection are connected with a pair of primary coils of a transformer acting as an ignition coil. Between the neutral point of the pair of the primary coils and a power source at least one diode is connected. The paired power transistors are turned on and off with a high frequency to generate in the secondary coil of the transformer high voltage trigger pulses and substantially continuous discharge voltages which last over a long period during each ignition period.

3 Claims, 11 Drawing Figures

CONTINUOUS TYPE IGNITION DEVICE FOR AN INTERNAL COMBUSTION ENGINE

CROSS-REFERENCE TO A RELATED APPLICATION

This application is related to U.S. Pat. No. 4,245,594, filed on Aug. 22, 1979 and U.S. patent application Ser. No. 181,243, filed Aug. 25, 1980, now U.S. Pat. No. 4,356,807, which are both assigned to the assignee of this application.

BACKGROUND OF THE INVENTION

This invention relates to ignition devices in particular to those capable of discharging sparks from ignition plugs substantially continuously over a long period of time. A conventional ignition device used in spark-ignition engines comprises an ignition coil and a breaker for causing, for every combustion cycle of an engine, single or multiple instantaneous discharges from the ignition plugs to ignite a compressed gaseous mixture.

However, such conventional devices cannot provide satisfactory ignition performance when the gaseous mixture is lean or a large amount of exhaust gas recirculation is effected, thus resulting in lower fuel economy and production of a great amount of harmful components in exhaust gases.

SUMMARY OF THE INVENTION

In view of the disadvantages of conventional devices mentioned above, this invention aims to provide ignition devices for engines, simple in structure yet capable of discharging sparks from ignition plugs substantially continuously over a long period of time, thereby improving the fuel economy of the engines and reducing the amount of harmful components in the exhaust gases.

The invention particularly utilizes a unified connection of a transformer having a pair of primary coils, diodes, and transistors to resolve the above mentioned problems.

DESCRIPTION OF THE PREFERRED EMBODIMENTS

Figure 1:
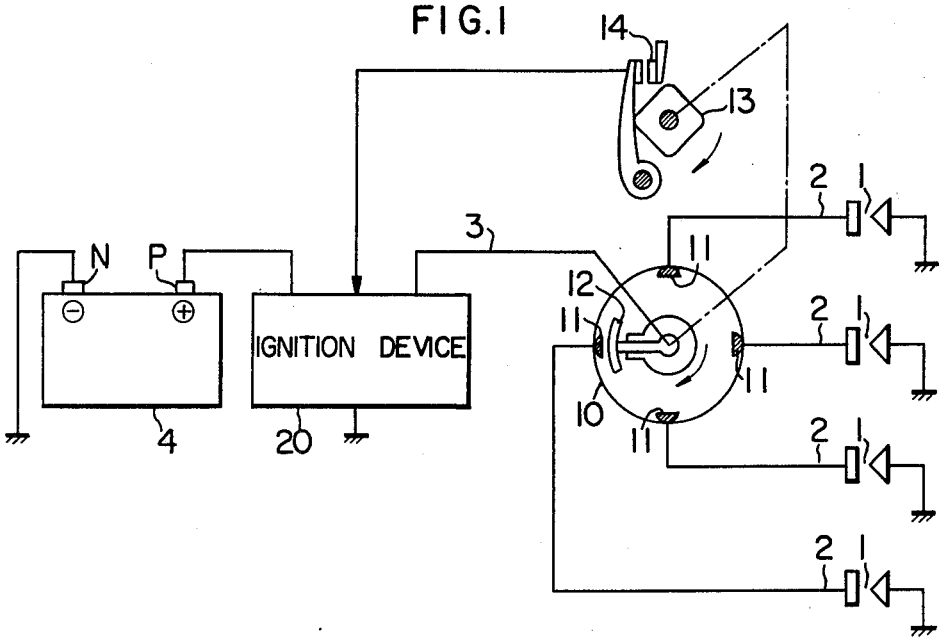
FIG. 1 is a diagramatic overall structure of an embodiment of the invention.

Referring to the embodiments illustrated in the drawings, the invention will now be described below. In FIG. 1, ignition plugs 1, shown schematically in the figure, are those of known types, each mounted on respective cylinder heads of the cylinders of an engine. It is assumed here that the engine (not shown) is a 4-cylinder, 4-cycle spark ignition engine for an automobile.

The ignition plugs 1 are adapted to receive a high voltage from an ignition device 20 via a distributer 10.

The ignition plugs 1 are connected with the distributer 10 by four high-tension cables 2, and the distributer 10 is in turn connected to the ignition device 20 by a high-tension cable 3.

The distributer 10 is a conventional one having electricity-receiving electrodes 11 angularly disposed with equal intervals along a circumference, and a rotatable electrode 12 which rotates once synchronously with the shaft of the engine for every two revolutions of the shaft. When the rotatable electrode 12 is turned to oppose one of the electricity receiving electrodes 11, the high-voltage from the ignition device 20 is applied to an ignition plug 1 associated therewith.

The distributer 10 is provided with a 4-lobe cam 13 which rotates integrally with the rotatable electrode 12 and with a breaker 14 which is closed or opened by the 4-lobe cam 13, the "on" and "off" signals of the breaker 14 indicative of the initiation and completion of spark discharges, respectively, are delivered to the ignition device 20.

The ignition device 20 is impressed with a DC voltage of approximately 12 volts by a vehicle battery 4 serving as a DC power source. The DC voltage is used to generate a high-voltage of approximately 20 kV.

Figure 2:
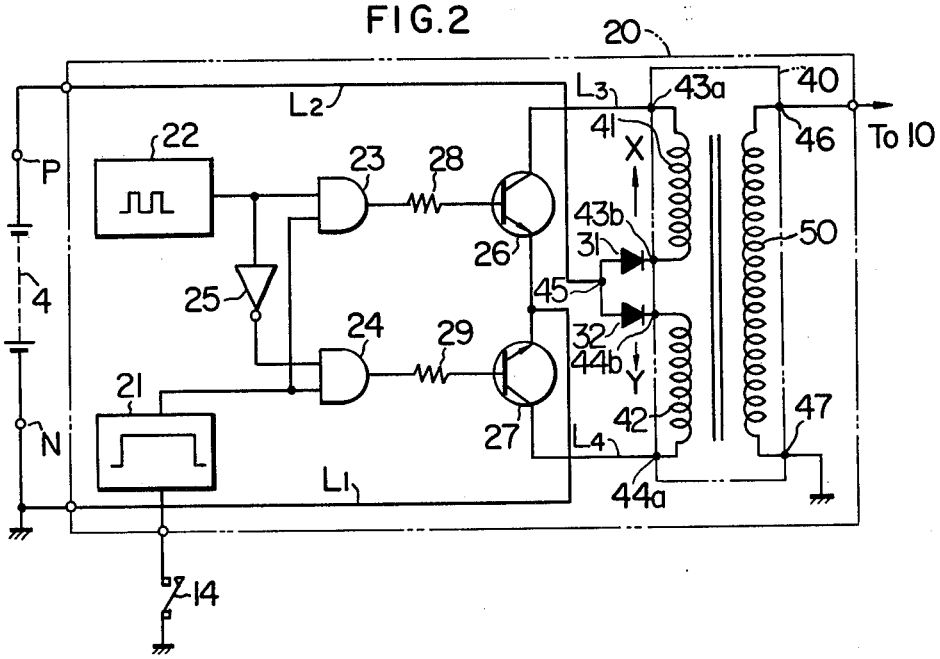
FIG. 2 is an electric circuit of the ignition apparatus of FIG. 1.

Referring to FIG. 2, the ignition device 20 will now be described in detail. A wave shaping circuit 21 is a well known type of circuit for converting input signals to rectangular pulse signals, to which circuit the on-off signals of the breaker 14 are delivered as the input signals therefor.

An oscillator circuit 22 comprises a well known astable multivibrator generating rectangular pulse signals of a constant frequency of approximately 5 kHz.

An AND gate 23 is a logical operational AND circuit for the wave shaping circuit 21 and the oscillator circuit 22, permitting output pulse signals of the oscillator circuit 22 to pass through the gate while the wave shaping circuit 21 is yielding a signal of level "1", and delivering a signal of level "0" whenever the wave shaping circuit 21 yields a signal of level "0".

An AND gate 24 is also a logical operational AND circuit for the output of the wave shaping circuit 21 and that of an inverter 25 for inverting output signals of the oscillator circuit 22, which gate 24 permits output pulse signals of the inverter 25 to pass therethrough when the wave shaping circuit yields signals of level "1", and delivers signals of level "0" whenever the wave shaping circuit 21 yields signals of level "0".

NPN type power transistors 26 and 27 are circuited so that they are each driven by the outputs of the AND gates 23 and 24, respectively, to perform push-pull operations. The base of the transistor 26 is connected with the output terminal of the AND gate 23 through the resistor 28, while the base of a transistor 27 is connected with the output terminal of the AND gate 24 through a resistor 29. The collectors of the transistors 26 and 27 are each connected with one terminal end 43*a* and 44*a* of primary coils 41 and 42 by leads $L_3$ and $L_4$, respectively. Furthermore, the emitters of the transistors 26 and 27 are connected with the negative terminal N of the battery 4 by a lead $L_1$.

A transformer 40 is comprised of the pair of primary coils 41 and 42 and a secondary coil 50 with their turn ratio ranging from 100 to 200. The transformer boosts up the voltage generated across the primary coils 41 and 42 to provide a high voltage output from the secondary coil 50. Terminals 43*b* and 44*b* of the primary coils 41 and 42, respectively, are connected with the cathodes of diodes 31 and 32, respectively. The anodes of the diodes 31 and 32 are both connected with the positive terminal P of the battery 4 by a lead $L_2$. Since the diodes 31 and 32 are thus positioned adjacent to each other, they can be easily integrated. A terminal 46 of the secondary coil 50 is connected with the rotatable electrode 12 of the distributer 10, while a terminal 47 thereof is grounded.

Figure 3:
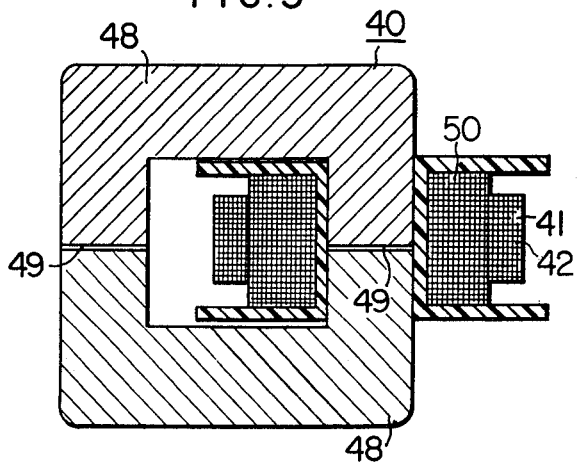
FIG. 3 is a sectional view of the transformer of FIG. 2.

As shown in FIG. 3, the primary coils 41 and 42 and the secondary coil 50 are wound on a bobbin which in turn is mounted on a pair of U-shaped ferrite cores or magnetic cores 48, which cores 48 form a closed magnetic loop and are separated by two gaps 49 of approximately 0.25 mm each i.e. approximately 0.5 mm in total.

Figure 4:
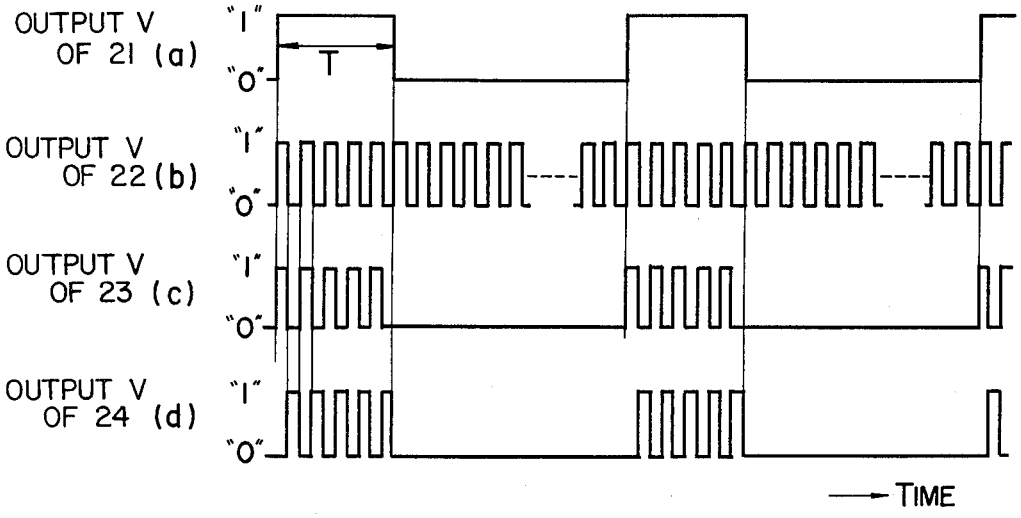
FIGS. 4 and 5 illustrate waveforms appearing at various points in the circuit.

With this arrangement, the 4-lobe cam 13 of the distributer 10 is kept in rotational motion during the operation of the engine so that the contact of the breaker 14 is turned ON or OFF repeatedly to yield pulses as depicted in FIG. 4(*a*) from the wave shaping circuit 21 of the ignition device 20, the wave shaping circuit 21 generating signals of level "1" as the contact of the breaker 14 is switched from the ON state to the OFF state, and signals of level "0" as the contact is switched from the "off" state to the "on" state.

On the other hand, the oscillator circuit 22 is generating rectangular pulses as shown in FIG. 4(*b*) with a constant frequency of approximately 5 KHz, while the inverter 25 generates such pulses as are inverted from the aforementioned pulses.

Thus, the AND gate 23 yields resultant pulse waves as shown in FIG. 4(*c*), while the AND gate 24 yields resultant waves as shown in FIG. 4(*d*). The power transistors 26 and 27, which can be turned on and off in response to the outputs of the AND gates 23 and 24, respectively, and repeat "on" and "off" as they are applied with pulses of opposite phases on their bases during the periods T shown in FIG. 4.

Figure 5:
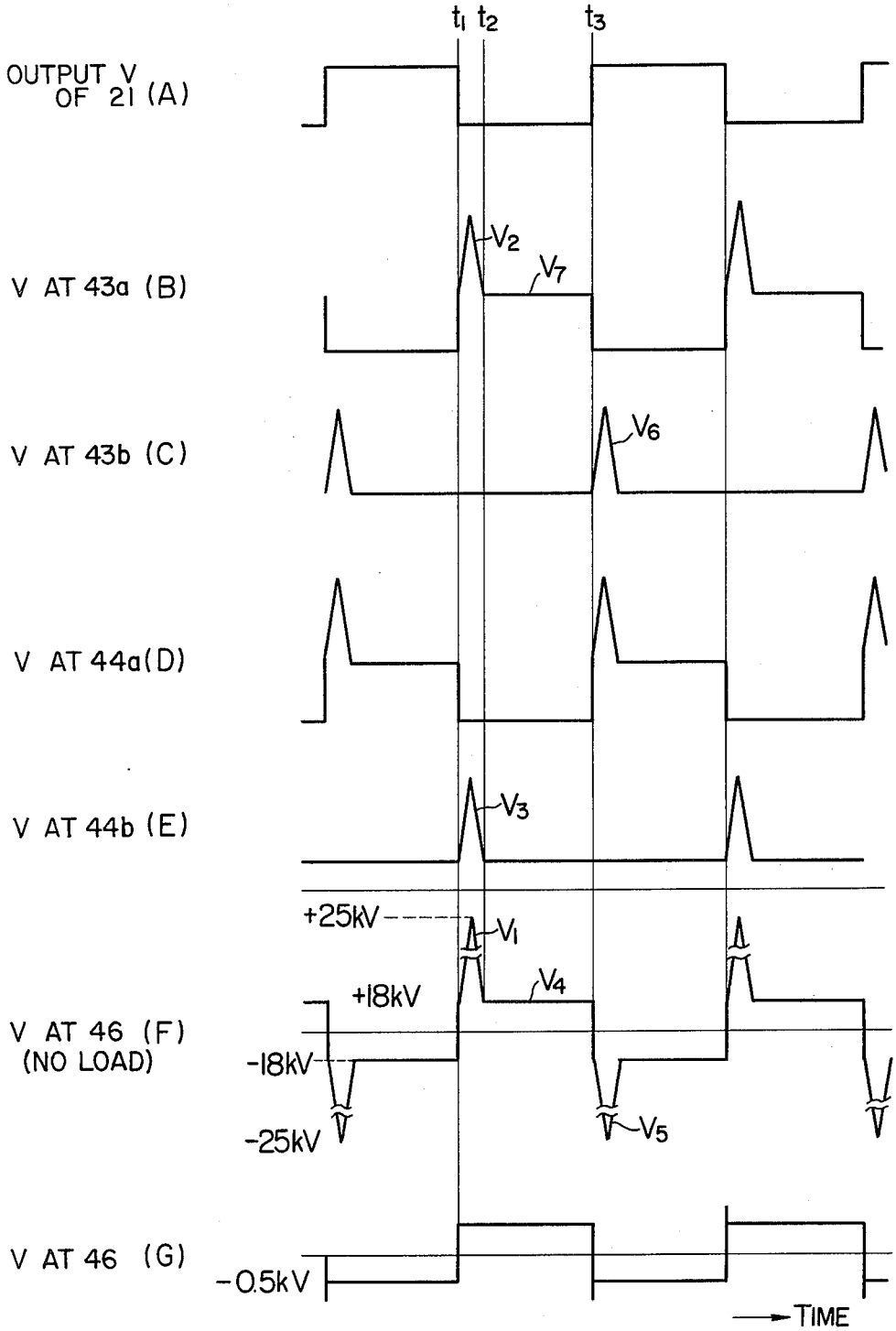

FIG. 5(*a*) shows in a smaller time scale the waveform of FIG. 4(*a*) during the period T. When the output of the AND gate 23 is changed in level from "1" to "0", the power transistor 26 is turned from "on" to "off", thereby abruptly cutting the primary coil current passing through the diode 31, the primary coil 41, and the power transistor 26 to resonate the inductance and the stray capacity of the secondary coil 50, for generating at the terminal 46 of the secondary coil 50 a trigger voltage having the waveform as shown in FIG. 5(F). The trigger voltage $V_1$ will generate in the primary coils 41 and 42 corresponding counter-electromotive forces $V_1$ and $V_2$, respectively. The potential at the terminal 43*b* of the primary coil 41 as shown by the waveform of FIG. 5(*c*), is of a magnitude approximately the same as that of the power source. Since, as shown by the waveform of FIG. 5(B), the potential at the terminal 43(*a*) of the primary coil 41 is positive, the counter-electromotive force $V_2$ generated across the primary coil 41 appears as an output. If the diode 32 were not provided, the potential at the terminal 44*b* of the primary coil 42 would be similar to the power source voltage, in which case, in order to generate a counter-electromotive force in the direction X indicated by an arrow in FIG. 2, the potential at the terminal 44*a* of the primary coil 42 should be negative. Such negative potential, however, could not be realized due to the electric current that would flow between the base and the collector of the power transistor 27 (i.e. reverse conduction therebetween). Accordingly, the counter-electromotive force $V_3$ generated in the primary coil 42 would be prevented, and the trigger voltage would then be smaller. With the diode 32 provided as in this invention, the potential of the terminal 44*b* of the primary coil 42 can be made positive as shown in FIG. 5(E) even when the potential of the terminal 44*a* of the primary coil 42 is made zero as shown in FIG. 5(D) on account of the reverse conduction of the power transistor 27. Consequently, the counter-electromotive force $V_3$ generated in the primary coil 42 appears as an output without reducing or weakening the trigger voltage $V_1$. When, at time $t_2$ the potential of the terminal 44*b* of the primary coil 42 is lowered from $V_3$ to the power source voltage, the power transistor 27 is turned on to allow an electric current to flow from the P terminal of the battery 4 through the diode 32, the primary coil 42, and the power transistor 27, thereby generating a counter-electromotive force $V_4$ to appear at the terminal 46 of the secondary coil 50, which voltage is lower than the trigger voltage but is still sufficiently high, and is provided as the voltage for continuous discharges. As the pulse height changes from "0" level to "1" level at the time $t_3$, the power transistor 27 is turned off to abruptly cut the primary coil current then flowing through the diode 32, the primary coil 42, and the power transistor 27, thereby providing a negative trigger voltage $V_5$ at the terminal 46 of the secondary coil 50 and, thanks to the presence of the diode 31, a counter-electromotive force in the direction Y indicated by an arrow in FIG. 2 will appear across the primary coil 41.

The above operation will subsequently be repeated to periodically generate in the secondary coil 50 of the transformer 40 high trigger voltages and continuous discharge voltages to be applied to the ignition plugs 1, the latter voltage being lower than the former yet sufficiently high. With no load imposed, a secondary voltage in the waveform as shown in FIG. 5(F) is generated in the secondary coil 50 to appear at the terminal 46. With the ignition plugs 1 connected, the secondary voltage will have a waveform as shown in FIG. 5(G).

During the period T determined by the "on" and "off" operation of the breaker 14, the rotatable electrode 12 of the distributer 10 is opposed with one of the electricity receiving electrodes 11 to impress an ignition plug 1 associated there with a high voltage from the ignition device 20.

The ignition plug 1 thus undergoes a capacitive discharge and a subsequent long and continuous discharge due to the secondary voltage $V_4$ corresponding to the primary voltage $V_7$.

This process will be subsequently repeated so that each ignition plug discharges in a substantially continuous and stable manner over a long period to ignite infallibly the gaseous mixture charged every time in an engine cylinder.

Because of this arrangement, the ignition performance is not lowered even when the gaseous mixture fed to the engine is lean or when a large amount of exhaust gas recirculation (EGR) is effected, thus improving its fuel economy and reducing the amount of harmful components in the exhaust gases.

Figure 6:
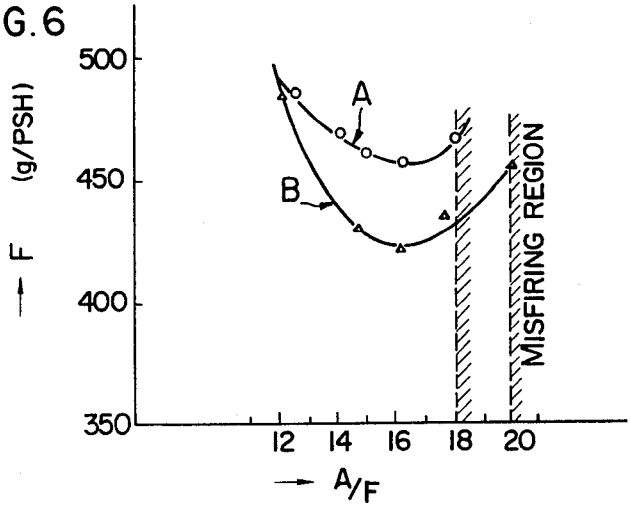
FIG. 6 is a graph showing the relationships between the air-fuel ratio and specific fuel consumption.

FIG. 6 shows the improved fuel economy observed under experimental conditions in which the rotational speed of the engine is 1400 rpm; the load torque, 1.2 kg-m. Taking the air-fuel ratio A/F to be 14.8 which is the stoichiometric air-fuel ratio, the specific fuel consumption F was found to be about 460 (g/PS·H) for a conventional ignition device, while F was improved to be about 425 (g/PS·H) for the ignition device of this invention. Where g/PS·H is a common unit for showing fuel consumption, i.e. fuel consumption per unit hour, unit output, and g is in grams, PS is in horsepower and H is in hours.

As shown in FIG. 6, while the misfiring region for a conventional ignition device lies above 18 in air-fuel ratio, where the engine is inoperable, such a misfiring region for the ignition device of this invention can be made to lie above 20 in air-fuel ratio. Thus it will be understood also from this result that the ignition performance is improved by the invention.

Figure 10:
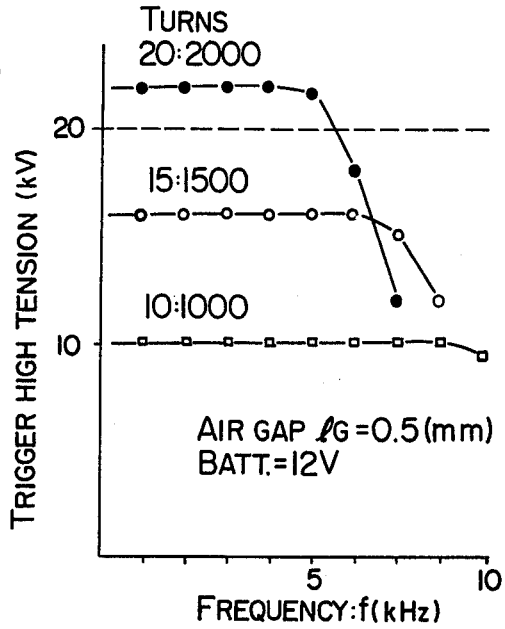
FIGS. 10 and 11 are graphs showing the experimental results for a device in accordance with this invention.
Figure 11:
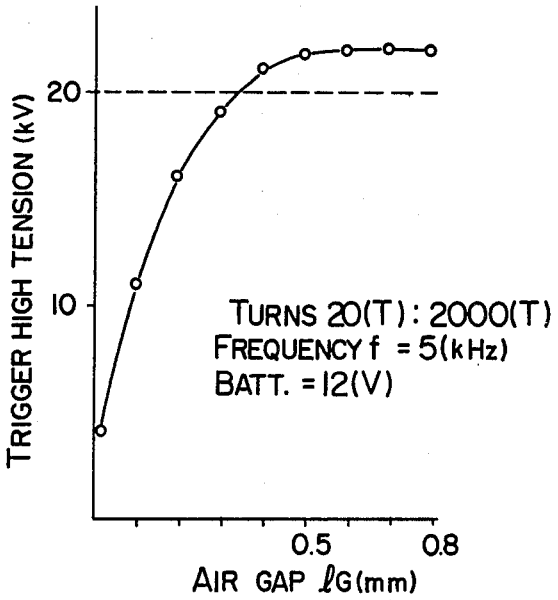

It has been found experimentally that for the turn ratio of the primary coil to the secondary coil of the transformer 40 of FIG. 3, appropriate numbers of turns of the primary and the secondary coils are 20 and 2000, respectively. FIG. 10 illustrates experimental results showing this fact. FIG. 11 shows the experimental relationship between the air gaps formed in the ferrite core 48 and the trigger voltage generated in the secondary coil 50. It is seen in this Figure that a maximum voltage is obtained with the air gap greater than 0.5 mm. On the other hand, the air gap is preferred to be as small as possible for the purpose of boosting the rectangular pulse to prolong the discharges following a high trigger voltage pulse.

Figure 7:
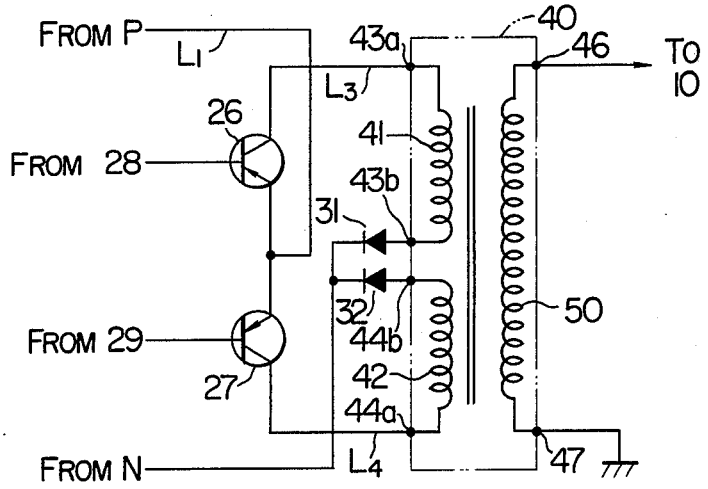
FIGS. 7, 8 and 9 are electric circuits for other embodiments of the invention.
Figure 8:
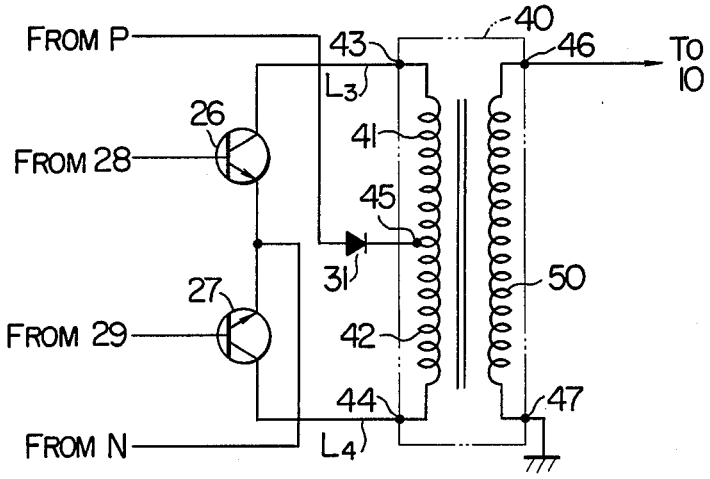
Figure 9:
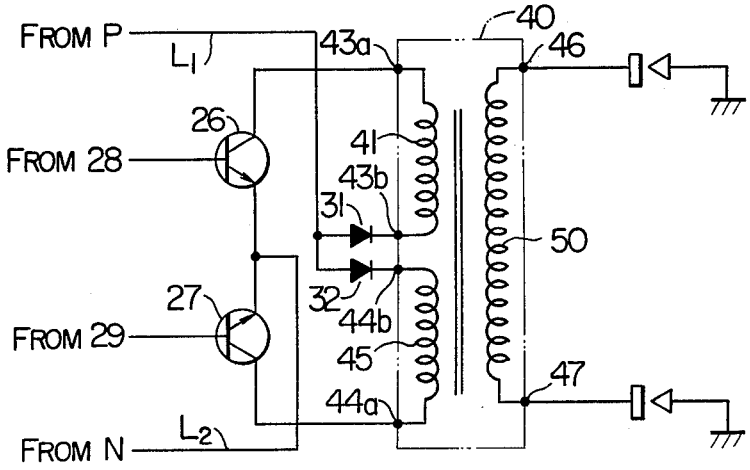

FIGS. 7, 8 and 9 show the electric circuits for other embodiments of the invention. Although NPN type transistors are used for the power transistors 26 and 27 in the above embodiment, PNP type transistors can be used equally well if the diodes 31 and 32 and the battery 4 are each connected in reversed directions, as shown in FIG. 7.

It should be noted in FIG. 8, that when power transistors having a rating voltage greater than double that of the above, only one diode will suffice, provided that it is connected with an intermediate terminal of the primary coil. This connection tends to reduce the stray capacities of the diode itself and of lead wires therefor.

In contrast to the above example where high voltages are distributed to the ignition plugs 1 by means of the distributer 10, the ignition plugs 1 may be directly connected with the terminals 46 and 47 of the transformer 40 as shown in FIG. 9 if the engine is a two-cylinder engine. The latter connection is of course applicable to a four-cylinder engine if two transformers 40 are provided.

It would be apparent that the ignition apparatus of the invention can be used for the ignition of gas turbines and boilers as well as for the ignition of the engine.

We claim:

1. An ignition device comprising:

a transformer having a core which is formed with an air gap therein, and primary and secondary coil means wound around said core;

said primary coil means including a primary coil having a center tap which provides a neutral point for said primary coil means;

a DC power source having a pair of output terminals;

an oscillator circuit for generating periodic pulses;

means for inverting said periodic pulses;

a pair of transistors in push-pull connection, one of said transistors having a base coupled to receive said periodic pulses and the other a base coupled to receive the inverted periodic pulses, said transistors having emitters connected with one of said output terminals of said DC power source, and having collectors connected with respective end terminals of said primary coil means; and a single diode connected from said neutral point to the other output terminal of said DC power source;

whereby high trigger voltages and continuous discharge voltages are generated periodically in said secondary coil when said transistors in push-pull connection are turned on and off in response to said pulses.

2. An ignition device as defined in claim 1, wherein the air gap of said magnetic core is greater than approximately 0.5 mm.

3. An ignition device as defined in claim 1, wherein the turns ratio of said primary coil means to said secondary coil means is approximately 1:100, and said primary coil means is more than 20 turns.

* * * * *